US005152222A

United States Patent [19]

Okamura et al.

[11] Patent Number: 5,152,222

[45] Date of Patent: Oct. 6, 1992

[54] COLOR PRINTING APPARATUS FOR BOTH SIDES OF PRINTING PAPER

[75] Inventors: Yuichi Okamura; Komei Kawahara, both of Tokyo, Japan

[73] Assignee: Kabushikigaisha Tokyo Kikai Seisakusho, Tokyo, Japan

[21] Appl. No.: 528,542

[22] Filed: May 25, 1990

[30] Foreign Application Priority Data

May 30, 1989 [JP] Japan ..... 1-137071

[51] Int. Cl.[5] ..... B41M 1/14

[52] U.S. Cl. ..... 101/211; 101/178; 101/179; 101/248; 29/125; 29/115

[58] Field of Search ..... 101/212, 220, 248, 211, 101/178, 179; 29/118, 121.2, 124, 125, 130, 115

[56] References Cited

U.S. PATENT DOCUMENTS

| | | | |
|---|---|---|---|
| 1,651,295 | 11/1927 | Shuttleworth | 29/125 |
| 2,578,921 | 12/1951 | Cramer | 29/121.2 |
| 2,962,962 | 12/1960 | Smith | 101/178 |
| 3,026,798 | 3/1962 | Frostad | 101/178 |
| 3,230.879 | 1/1966 | Worthington | 29/118 |
| 3,289.580 | 12/1966 | Dutro | 101/179 |
| 3,329.086 | 7/1967 | Pullen | 101/179 |
| 3,746,957 | 7/1973 | Forster et al. | 101/211 |
| 4,207,815 | 6/1980 | Watanabe | 101/248 |
| 4,534,288 | 8/1985 | Brovman | 101/211 |
| 4,586,434 | 5/1986 | Tokuno et al. | 101/178 |
| 4,697,515 | 10/1987 | Germann | 101/179 |
| 4,766.809 | 8/1988 | Giori et al. | 101/179 |
| 4,768.436 | 9/1988 | Hermach et al. | 101/179 |

FOREIGN PATENT DOCUMENTS 59-31467 2/1984 Japan .

OTHER PUBLICATIONS

"Newspaper Technique Information", vol. 20, No. 15, Aug. 1988, Nippon Newspaper Assoc., pp. 4-19.

"Papers Science", Research Assoc. of Chugai Sangyo Inc., 3rd Issue, Mar. 1982.

*Primary Examiner*—Eugene H. Eickholt

*Attorney, Agent, or Firm*—Foley & Lardner

[57] ABSTRACT

A color printing apparatus printing for both sides of a web of printing paper comprises a plurality of printing sections which are arranged at a regular interval in a piled configuration. Each one of the printing section includes a pair of blanket cylinders facing each other which can be moved between their contacting positions and their isolating position. Every blanket cylinder is connected to a plate cylinder which is connected to an inking unit, or an inking unit and a dampening unit. Each of the plate cylinders is further provided with a fine adjusting means for shifting the plate cylinder along its axis with respect to the blanket cylinder. The shifting operation of the fine adjusting means can easily minimize the printing shears caused by moisture without stopping the printing apparatus.

10 Claims, 5 Drawing Sheets

COLOR PRINTING APPARATUS FOR BOTH SIDES OF PRINTING PAPER

BACKGROUND OF THE INVENTION

1. Field of the Invention

The present invention generally relates to color printing apparatus adapted for printing both sides of a printing paper.

2. Description of the Prior Art

Conventionally, various color printing apparatus for both sides of a printing paper have been well known. One example of such type apparatus has been shown in "Newspaper Technique Information Vol. 20, No. 15" published by Nippon Newspaper Association, dated on Aug. 1, 1988; especially referred to the description from line 1 on page 4 to line 19 on page 10. Such type of apparatus comprises a plurality of printing sections which are isolately arranged in a vertical line a piled state. Each of the printing sections includes a pair of blanket cylinders which can be alternately moved between a contact position and isolated position. The blanket cylinders each have a plate cylinder.

FIG. 6 shows one example of detailed structure of such an apparatus. First, second, third and fourth printing sections 201, 202, 203 and 204 include facing pairs of blanket cylinders 211 and 221; 231 and 241; 251 and 261; and 271 and 281, respectively. The first and second printing sections 201 and 202 are closely arranged, and the third and fourth printing sections 203 and 204 are also closely arranged. Accordingly, the second printing section 202 and the third printing section 203 are arranged apart from each other. On the whole, this layout can shorten the printing length from the first printing section 201 to the fourth printing section 204. Further, plate cylinders 212, 222, 232, 242, 252, 262, 272, and 282, which belong to the printing sections 201, 202, 203, and 204, are respectively provided with plate side adjusting means for adjusting a plate on the plate surface when the plate cylinders are kept in their stop state. The plate side adjusting means is shown in FIG. 8 on page 10 of the above described publication.

The first, second, third and fourth printing sections 201, 202, 203 and 204 include inking units 213 and 223; 233 and 243; 253 and 263; and 273 and 283 and dampening units 214 and 224; 234 and 244; 254 and 264; and 274 and 284, respectively. In the first and third printing sections 201 and 203, the inking units 213 and 223; and 253 and 263 and the dampening units 214 and 224; and 254 and 264 are arranged below the plate cylinders 212 and 222; and 252 and 262, respectively. In the second and fourth printing sections 202 and 204, the inking units 233 and 243; and 273 and 283 and the dampening units 234 and 244; and 274 and 284 are arranged below the plate cylinders 232 and 242; and 272 and 282, respectively.

On the other hand, a printing paper, particularly in a web shape, tends to vary its dimension by moisture. In detail, the dimension of the paper web is sensitive to the ink and the dampening water which are transferred at printing operation. The change in the dimension of the paper web W is remarkably generated in the lateral direction of the paper web because of the wettability of pulp fibers forming the paper web and the orientation of the pulp fibers by paper making. This phenomenon has been well known, and is for example referred to in "Chemistry of Paper" published by Research Association of Chugai Sangyo Inc., 3rd Issue, Mar. 25, 1982.

In a conventional apparatus in which colored ink is applied to both sides of the paper, the distance from the first printing section 201 to the fourth printing section 204 is shortened as much as possible to enable the paper web w to pass through the whole printing sections from the first section 201 to the fourth section 204 within a short period. This arrangement is intended to reduce the influence of moisture upon the printing quality. In other words, the printed pattern by the first printing section 201 deviates more from that printed by the second, third and fourth printing sections 202, 203 and 204 than the central area of the printed pattern because the dimension of the lateral sides of the paper web varies more under the moisture condition than the central area of the paper web. In order to eliminate the deviation as much as possible, the conventional apparatus employs a plate side adjusting means provided at every plate cylinders 212, 222, 232, 242, 252, 262, 272, and 282 for adjusting the plates on the plate cylinders, respectively.

However, conventional plate side adjusting means can not be operated while the plate cylinders 212, 222, 232, 242, 252, 262, 272, and 282 are revolving. To adjust the position of the plates on the plate cylinders, the cylinders should be completely stopped. This adjusting work requires skilled operators.

Further, this adjusting system will cause extremely poor operation efficiency if each rolled paper web is exactly corrected in response to the variation in the dimension depending on each web so that this adjusting operation has been practically employed.

In conventional printing apparatus as shown in FIG. 6, while the dampening units 214, 224, 254 and 264, arranged below the plate cylinders 212, 222, 252 and 262 of the first and third printing sections are disposed inwardly of the inking units 213, 223, 253 and 263, the dampening units 234, 244, 274 and 284, arranged above the plate cylinders 232, 242, 272 and 282 of the second and fourth printing sections, are disposed outwardly of than the inking units 233, 243, 273 and 283. These arrangements are remarkably complicated so that operation efficiency will become poor and operation mistakes will occurs often. Further, these arrangements may cause various problems in view of design, manufacturing, maintenance, and so on.

In fluid supplying systems such as the dampening units and the inking units, the fluid flowing in a downward-direction tends to feed a greater amount than that of the fluid flowing in the upward-direction owing to the influence of gravity upon the fluid flow. Thus, the dampening units 234, 244, 274 and 284; and the inking units 233, 243, 273 and 283, arranged above the plate cylinders 232, 242, 272 and 282, and it is more difficult to finely control their feeding amount than that of the dampening units 214, 224, 254 and 264; and the inking units 213, 223, 253 and 263 arranged below the plate cylinders 212, 222, 252 and 262. This control requires extremely skillful operators. Further, the dampening units 234, 244, 274 and 284; and the inking units 233, 243, 273 and 283 arranged above the plate cylinders 232, 242, 272 and 282, requires means for preventing excess feeding of dampening water and ink. For example, the downstream rollers should be arranged higher than the upperstream rollers. This further requires space for roller arrangement, additional consideration in design, and so on. In addition to these disadvantages, this requirement is an obstruction to the minimization of the roller numbers and to the realization of a compact body of the printing apparatus.

Although a color printing operation always requires a complete agreement of each color printed pattern, conventional both sides color printing apparatus can not completely perform such pattern agreement because the distance between the first printing section 201 and the second printing section 202 and between the third printing section 203 and the fourth printing section 204 is different from the distance between the second printing section 202 and the third printing section 203. More specifically, the circumferential phase of the plate cylinders 212 and 222 associated with the first printing section is difficult to align that of the plate cylinders 232, 242, 252, 262, 272 and 282 associated with the second, third and fourth printing sections 202, 203, 204. Thus, the circumferential phases of the plate cylinders 212, 222, 232, 242, 252, 262, 272 and 282 are firstly adjusted to be substantially the same, and then the respective plates are simultaneously mounted on them. This simultaneous mounting operation results in a complicated configuration. If such a complicated configuration is not completely designed, the simultaneous mounting operation will not result and therefore this will cause a poor efficiency in the printing operation.

BRIEF SUMMARY OF THE INVENTION

It is therefore an object of the present invention to provide a both sides color printing apparatus which can minimize printing shears caused by variations in the dimension of a paper web on account of moisture without stopping the apparatus.

Another object of the present invention is to provide a both sides color printing apparatus which provides an improved printing operation with high efficiency.

A further object of the present invention is to provide a both sides color printing apparatus which is free from operation troubles.

Furthermore, another object of the present invention is to provide a both sides color printing apparatus which is improved in design, manufacture, maintenance, parts stock, and so on.

To accomplish the above described objects, the both sides color printing apparatus according to the present invention comprises a plurality of printing sections which are isolately arranged in a piled configuration. Each one of the printing section includes a pair of blanket cylinders facing each other which can be moved between their contacting position and an isolating position. Every blanket cylinder is connected to a plate cylinder which is connected to an inking unit, or an inking unit and a dampening unit. Each of the plate cylinder is further provided with a fine adjusting means for shifting the plate cylinder along its axis with respect to the blanket cylinder. The fine adjusting means comprises a threadingly slidable member fixed on one end of the axis of the plate cylinder.

According to the above configurated both sides color printing apparatus, the fine adjusting means associated with each of the plate cylinders is operated to shift the respective plate cylinder along its axis with respect to the blanket cylinder. This shifting direction corresponds to the variation in the dimension of the paper web, so that the printing shears can be minimized. When the printing plate, mounted on the plate cylinder or the printing pattern formed on the plate cylinder, is composed of a plurality of printing plates or divided sections of the printing pattern, the circumferential surface of the plate cylinder is also divided in its axial direction and each of the divided printing patterns on the plate cylinder is adjusted by the fine adjusting means with respect to the blanket cylinder.

In order to adjust the position of the plate cylinder or the divided printing pattern, the threadingly slidable member of the fine adjusting means can shift the end of the axis of the plate cylinder while maintaining constant the revolution of the plate cylinder. In other words, the plate cylinder can be adjusted with respect to the blanket cylinder without stopping the printing system.

Other objects and features of the invention will become apparent from a reading of the following description of the disclosure found in the accompanying drawings and the novelty thereof pointed out in the appended claims.

BRIEF DESCRIPTION OF THE DRAWINGS

FIG. 1 to FIG. 5 show one preferred embodiment of the both sides color printing apparatus according to the present invention; wherein, FIG. 1 is a schematic illustration showing one example of a configuration of the both sides color printing apparatus;

FIG. 2 is a partially sectional view showing one example of the fine adjusting means mounted on the end of the plate cylinder;

FIG. 3 is a partially sectional view showing a modification of the means shown in FIG. 2;

FIG. 4 is a partially sectional view showing one example of a plate cylinder the circumferential surface of which is divided in its axial direction;

FIG. 5 is a partially sectional view showing one example of the fine adjusting means mounted on the end of the plate cylinder shown in FIG. 4.

DETAILED DESCRIPTION OF THE PREFERRED EMBODIMENT

Figure 1:
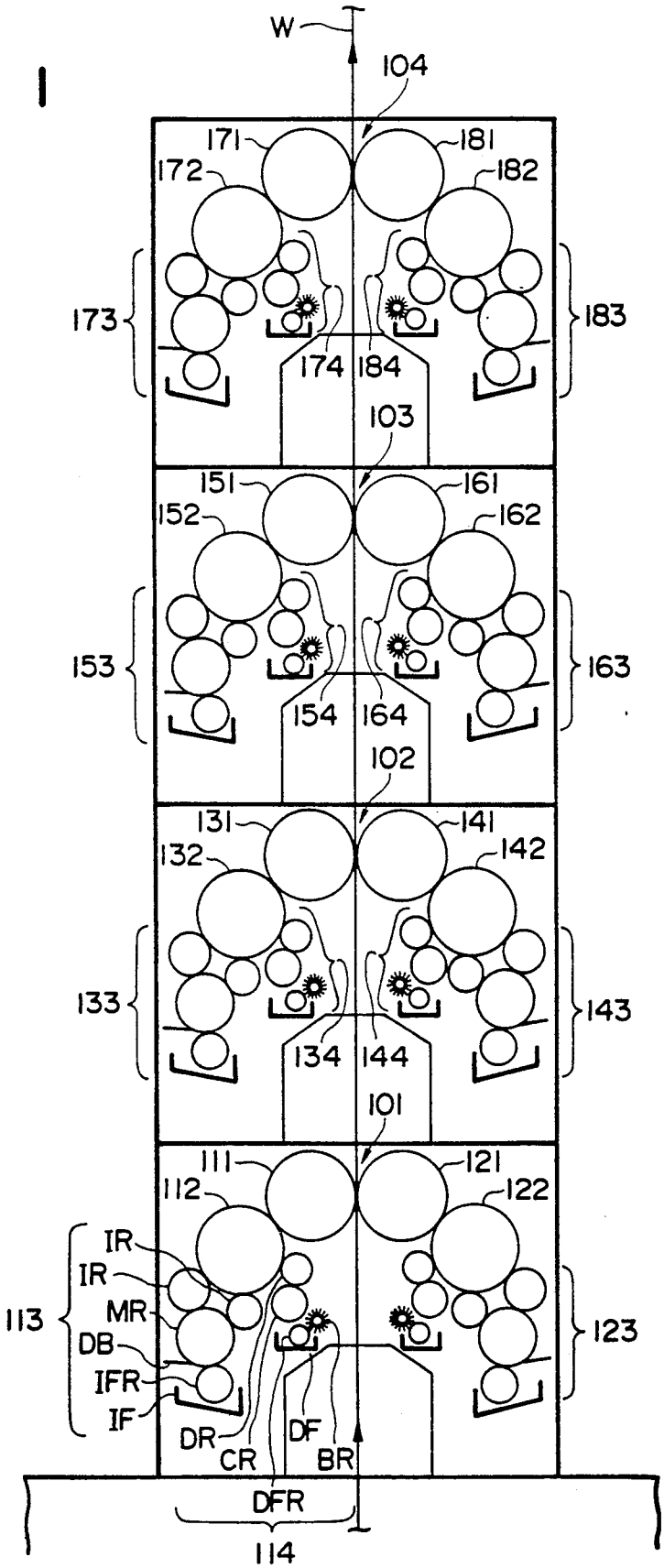

One preferred embodiment of the present invention will be described in detail with reference to the accompanying drawings FIGS. 1 to FIG. 5.

In the drawings, W denotes a paper web to be printed. Numerals 101, 102, 103 and 104 denote first, second, third and fourth printing sections. These first, second, third and fourth printing sections 101, 102, 103 and 104 include a pair of blanket cylinders 111 and 121; 131 and 141; 151 and 161; and 171 and 181, respectively. The paper web W travels upwardly in FIG. 1 to pass from the first printing section 101 to the fourth printing section 104 in the order so that both sides of the paper web W are printed with four colors.

The blanket cylinders 111, 121, 131, 141, 151, 161, 171 and 181 are respectively covered with a blanket, not shown, and connected to plate cylinders 112, 122, 132, 142, 152, 162, 172, and 182. On the plate cylinders 112, 122, 132, 142, 152, 162, 172, and 182, printing plates, not shown, are respectively mounted on their circumferential surfaces, or printing patterns corresponding to the printing plates can be formed thereon. The plate cylinders 112, 122, 132, 142, 152, 162, 172, and 182 are respectively connected to inking units 113, 123, 133, 143, 153, 163, 173, and 183, each of which is provided with and ink fountain IF having an ink fountain roller IFR at least partially disposed therein, a metering roller MR which contacts the ink fountain roller and a doctor blade DB, and inking rollers IR which are disposed intermediate metering roller MR and the respective plate cylinder. In this embodiment, as shown in FIG. 1, they are respectively provided with dampening units 114, 124, 134, 144, 154, 164, 174 and 184, each of which includes a dampening water fountain DF, a dampening fountain roller DFR, a brush roller BR, a chromium roller CR, and a dampening roller DR. The inking unit and the dampening unit are not only limited to the above described configuration.

Figure 2:
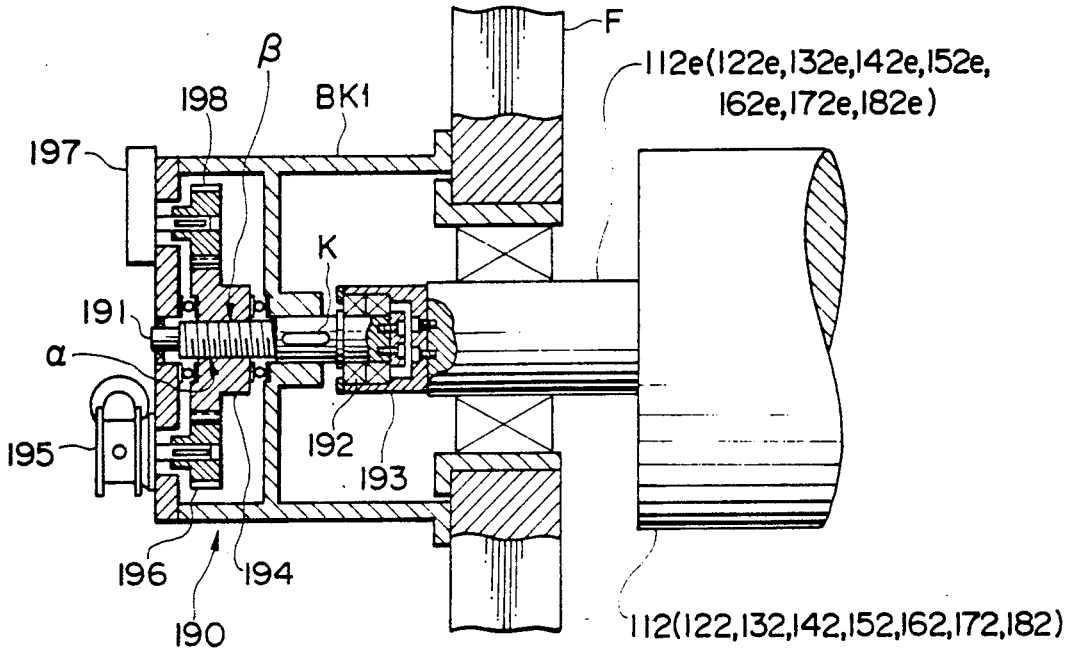

Each of the plate cylinders 112, 122, 132, 142, 152, 162, 172, and 182 is provided with a fine adjusting means 190 an example of which is shown in FIG. 2.

FIG. 2 shows a detailed structure of the fine adjusting means 190 assembled on the plate cylinder 112. The fine adjusting means 190 comprises an adjusting shaft 191 whose center is formed with a male screw section $\alpha$. The adjusting shaft 191 is slidably mounted on a frame F through a key K and a bracket BK1. Further the adjusting shaft 191 is connected to one end of the axis 112*e* of the plate cylinder 112 through a bearing 192 and a bearing housing 193. The male screw section $\alpha$ is threadingly engaged with a first gear 194 through a through-female screw section $\beta$. The first gear 194 is meshed with a second gear 196 which is driven by a diving unit 195. Further, the fine adjusting means 190 is provided with a sensor 197 which senses the adjusted degree of shaft 191 through a third gear 198 meshed with the first gear 194. The driving unit 195 may be replaced with a handle, not shown.

Figure 3:
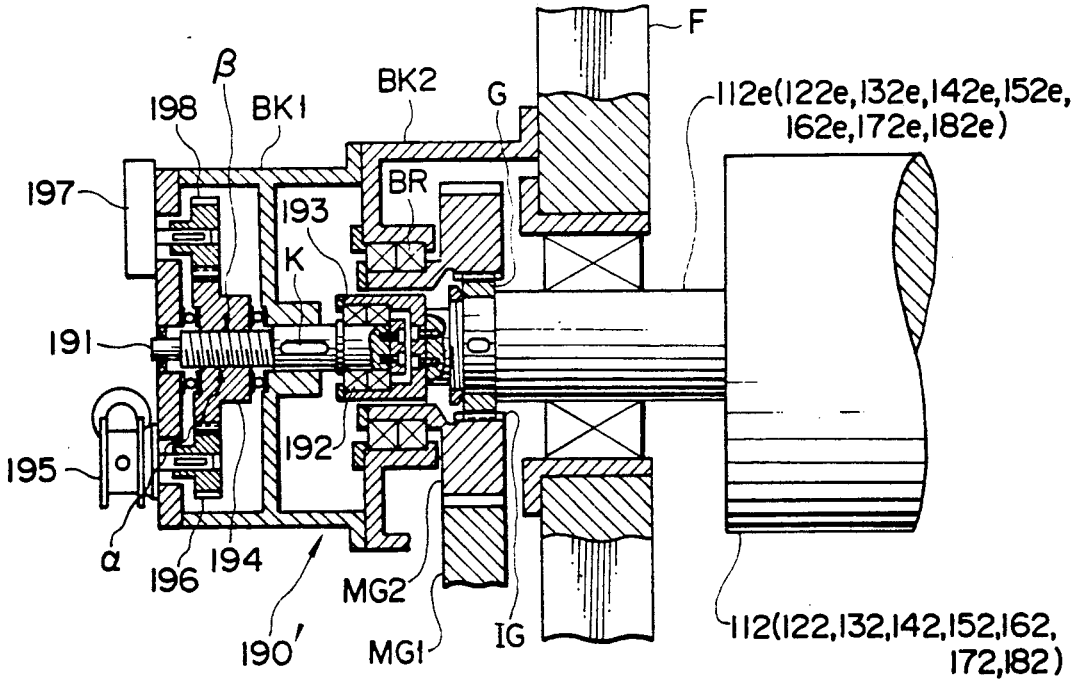

FIG. 3 shows one modification of the fine adjusting means 190 shown in FIG. 2. The modified adjusting means 190' includes a gear mechanism composed of a main driving gear MG1 for driving the plate cylinder 112 and a driven gear MG2 meshed with the main driving gear MG1. In detail, the driven gear MG2 is rotatably supported by a bracket BK2 through a bearing BR, and is meshed with an internal gear IG for transmitting the revolving force from the driven gear MG2 to the plate cylinder 112 through the axis 112*e*. Further, the internal gear IG is meshed with a gear G which is slidably moveable in the axial direction of the axis 112*e*.

Figure 4:
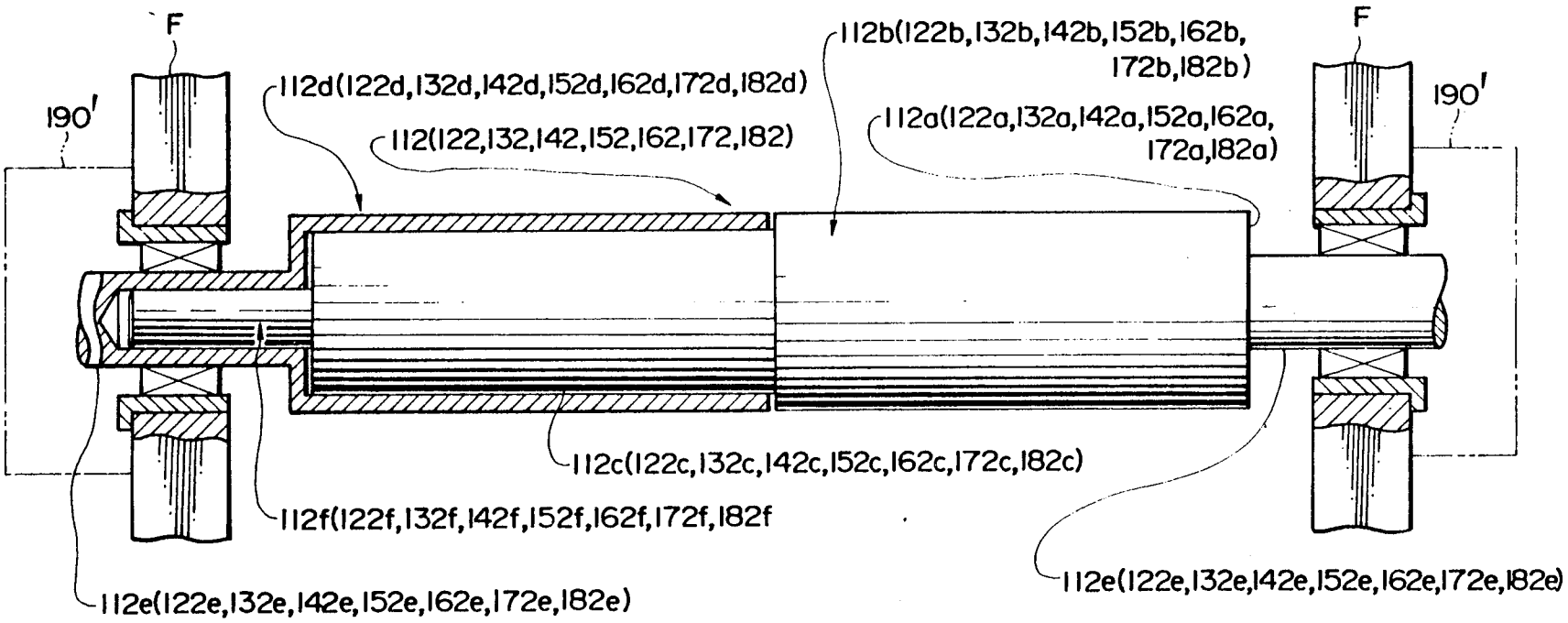

If the width of the respective plate cylinders 112, 122, 132, 142, 152, 162, 172, and 182 is so great that four pages of newspaper and their printing patterns can be divided into several sections, their printing plates will be configurated in the manner, shown for example in Japanese Patent Publication No. 59-31467 titled "Plate Cylinder Device in Rotary Press". In detail, as shown in FIG. 4, the circumferential surface of the plate cylinder 112 is divided into two sections. The other plate cylinders are configured in the same as the plate cylinder 112. One of the two sections, a first section 112*a*, includes a larger diameter member 112*b* having the same external diameter of the plate cylinder and a smaller diameter member 112*c* extended from the larger diameter member 112*b*. The other of the two sections, a second section 112*d*, is formed in a sleeve having the same external diameter as that of the plate cylinder. The second section 112*d* is slidably mounted on the smaller diameter member 112*c* of the first section 112*a*. The first and second sections 112*a* and 112*d* have, respectively; a right end shaft 112*e* and a left end shaft 112*e'*. The left end shaft 112*e'* further includes a hollow cylindrical space in which an end shaft 112*f* of the smaller diameter member 112*c* is slidably engaged. The right end shaft 112*e* of the first section 112*a* and the left end shaft 112*e* of the second section 112*d* are respectively provided with the plate cylinder fine adjusting means 190' as shown in FIG. 3.

Figure 5:
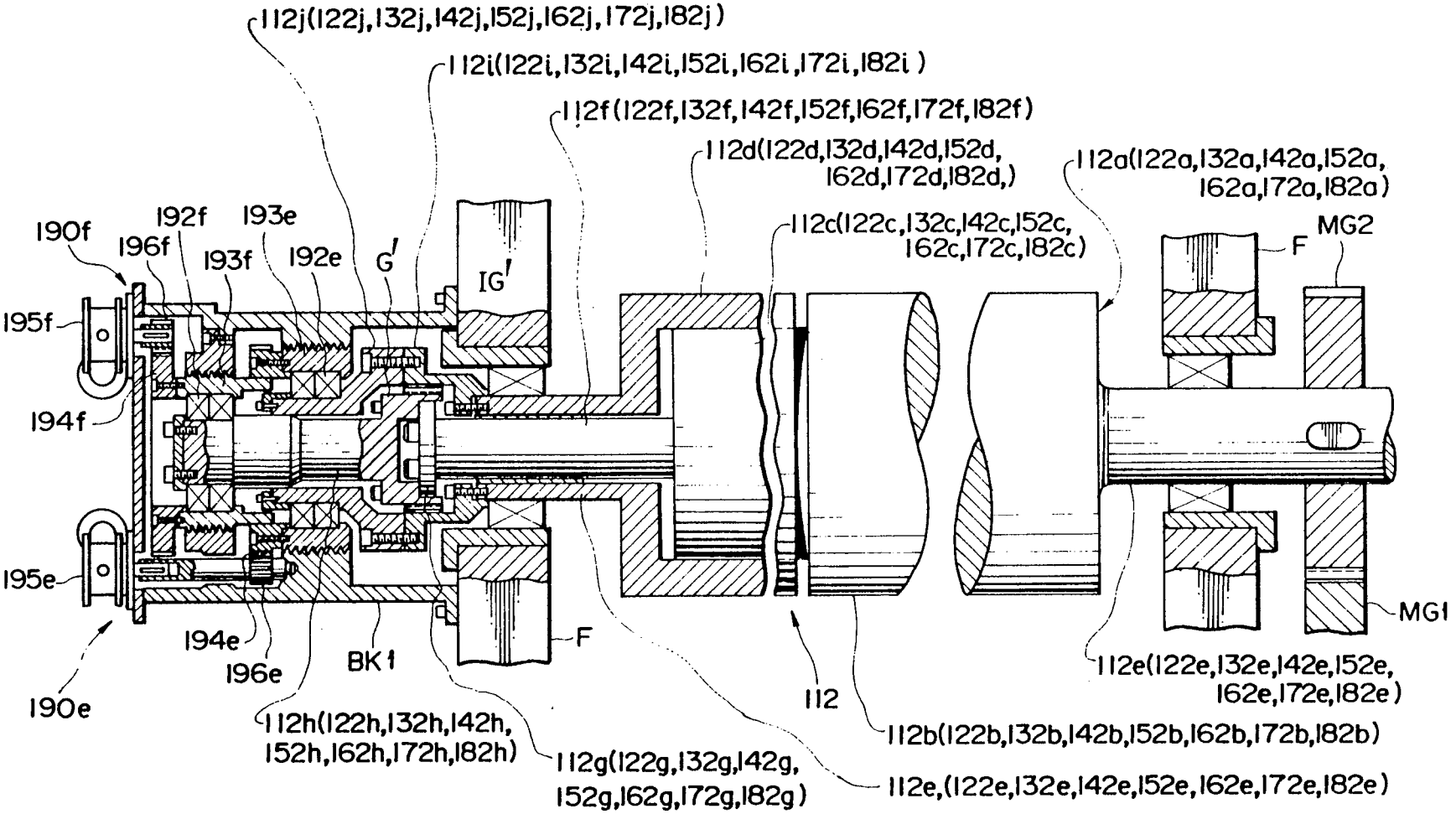

FIG. 5 shows one example of the assembled configuration of the plate cylinder fine adjusting means. The end shaft 112*f* of the smaller diameter member 112*c* is extruded from, i.e. integral with the left end shaft 112*e'* of the second section 112*d*. The end shaft 112*f* of the smaller diameter member 112*c* and the left end shaft 112*e'* of the second section 112*d* are coaxially provided with the plate cylinder fine adjusting means 190*f* and 190*e*, respectively. Members represented by 192*e* to 196*e*; and 192*f* to 196*f* in FIG. 5 correspond to the members 192 to 196 in FIG. 2, respectively. Further, the adjusting shaft 191 shown in FIG. 2 can be replaced by bearing housings 193*e* and 193*f* the external surfaces of which are formed with male screw sections. The members corresponding to the sensor 197 and the third gear 198 in FIG. 2 are not shown in FIG. 5.

In the plate cylinder 112 shown in FIG. 5, a driving force is transmitted from a main driving gear MG1 to a driven gear MG2 mounted on the end shaft 112*e* of the greater diameter member 112*b* of the first section 112*a*. Then the driving force is transmitted to the left end shaft 112*e'* of the second section 112*d* through the first section 112*a*, the left end shaft 112*f* of the smaller diameter member 112*c*, a first additional shaft 112*h* provided with a gear unit G' which is fixed to the left end shaft 112*f* through a first block 112*g*, and a second block 112*i* fixed on the second section 112*d* and provided with an internal gear unit IG' which is slidably meshed with the gear unit G'. Accordingly, the first section 112*a* and the second section 112*d* are integrally revolved as a single body by this transmitted driving force.

A typical operation of the above configured apparatus will be described on only the plate cylinder 112 because the other plate cylinders 122, 132, 142, 152, 162, 172 and 182 are essentially same as the plate cylinder 112. As a main switch, not shown, of the printing apparatus is turned on, the printing plate or the printing patterns corresponding to the printing plate formed on the plate cylinder 112 is supplied with ink from the inking unit 113 and dampening water from the dampening unit 114. The ink and the dampening water are upwardly supplied to the lower surface of the plate cylinder 112. The printing pattern is transferred to the blanket surface of the blanket cylinder 111 owing to contact and relative rotation between the printing plate or the printing pattern on the plate cylinder 112 and the blanket on the blanket cylinder 111. The transferred printing pattern is then printed on one surface of the paper web W travelling through the first printing section. On the same occasion, another printing pattern is printed on the other surface of the paper web W by the blanket cylinder 121 in the same manner as the blanket cylinder 111.

After the first printing step, the paper web W is swelled with the ink and the dampening water. Especially, the lateral direction of the paper web W is remarkably varied. In other words, the printed patterns formed on the paper web W at the first printing section 101 become greater or wider than the printing patterns to be printed at the second, third, and fourth printing sections 102, 103 and 104. When the printing patterns is not uniformly laid out on the printing plate, the low density area and the lateral side area of the printing pattern printed on the paper web W are more varied. Thus the fine adjusting means 190 or 190' for the plate cylinders 132, 142, 152, 162, 172 and 182 are respectively actuated to shift the plate cylinders in their axial direction. This shifting distance is adjusted so as to minimize the differences of the printed patterns; that is, to substantially unify the differences of the printed patterns in the lateral sides of the paper web.

When the plate cylinder 112 is configured as shown in FIG. 4, its first and second sections 112*a* and 112*d* are respectively actuated by the fine adjusting means 190' assembled on the end shafts 112*e* and 112*e'*. Alternatively, when the plate cylinder 112 is configured as shown in FIG. 5, its first and second sections 112*a* and 112*d* are respectively actuated by the fine adjusting means 190*f* mechanically connected to the end shaft 112*f* of the smaller diameter member 112*c* of the first section 112*a* and the fine adjusting means 190*e* mechanically connected to the end shaft 112*e* of the second section 112*d*. Both of the first and second sections 112*a* and 112*d* of the plate cylinder 112 are independently actuated, or either of them can be actuated. The other plate cylinders 122, 132, 142, 152, 162, 172 and 182 are operated in the same manner as the plate cylinder 112.

Next, a typical operation of the fine adjusting means 190 and 190 shown in FIGS. 2, 3 and 4 will be described in detail. The driving unit 195 is actuated to rotate in the required direction. This driving force is transmitted to the first gear 194 through the second gear 196. As the first gear 194 revolves, the adjusting shaft 191 is shifted in its axial direction by the combination of the female screw section $\beta$ formed in the first gear 194 and the male screw section $\alpha$ formed in the adjusting shaft 191. This shifted motion is transmitted to the plate cylinder 112 through the bearing 192, the bearing housing 193, and the end shaft 112*e* so that the plate cylinder 112 per se can be moved in its axial direction. Since the adjusting shaft 191 is connected to the bearing housing 193 fixed on the end shaft 112*e* through the bearing 192, this adjusting operation can be performed whether the plate cylinder 112 is revolving or not.

A typical operation of the fine adjusting means 190*e* and 190*f* shown in FIG. 5 will be described in detail Since the fine adjusting means 190*f* is operated in the same manner as the means 190*e*, the same description will not be repeated. The components or parts of the fine adjusting means 190*f* corresponding to the means 190*e* will be added after them with parenthesis.

The driving unit 195*e* (195*f*) is actuated to rotate in the required direction. This driving force is transmitted to the first gear 194*e* (194*f*) through the second gear 196*e* (196*f*). As the first gear 194*e* (194*f*) is revolved, the bearing housing 193*e* (193*f*), fixedly provided with the first gear, is revolved with the thread engagement between the female screw section formed in or fixed on the first bracket BK1 and the male screw section formed in the external surface of the bearing housing 193*e* (193*f*), and shifted in its axial direction. This shifted motion is transmitted to the first section 112*a* (the second section 112*d*) of the plate cylinder 112 through the bearing 192*e* (192*f*), the second additional shaft 112*j* (the first additional shaft 112*h*), the second block 112*i* (the first block 112*g*), and the end shaft 112*e'*(112*f*) so that the first section 112*a* (the second section 112*d*) can be moved in its axial direction. Since the second additional shaft 112*j* (the first additional shaft 112*h*) fixed on the end shaft 112*e'*(112*f*) through the second block 112*i* (the first block 112*g*) is connected to the bearing housing 193*e* (193*f*) through the bearing 192*e* (192*f*), this adjusting operation can be performed whether the plate cylinder 112 is revolving or not.

In the fine adjusting means 190 (190', 190*e* and 190*f*), when the driving unit 195 (195*e* and 195*f*) is replaced by a handle, not shown, the handle can be revolved in the required direction as like as the driving unit 195 (195*e* and 195*f*).

Further, the sensor 197 of the fine adjusting means 190 (190'), shown in FIG. 2 and FIG. 3, detects the revolved degree of the first gear 194 through the third gear 198 under the operating condition and converts it into an electric signal representing the shifted distance of the plate cylinder 112 or the first section 112*a* or the second section 112*d* of the plate cylinder 112.

Figure 6:
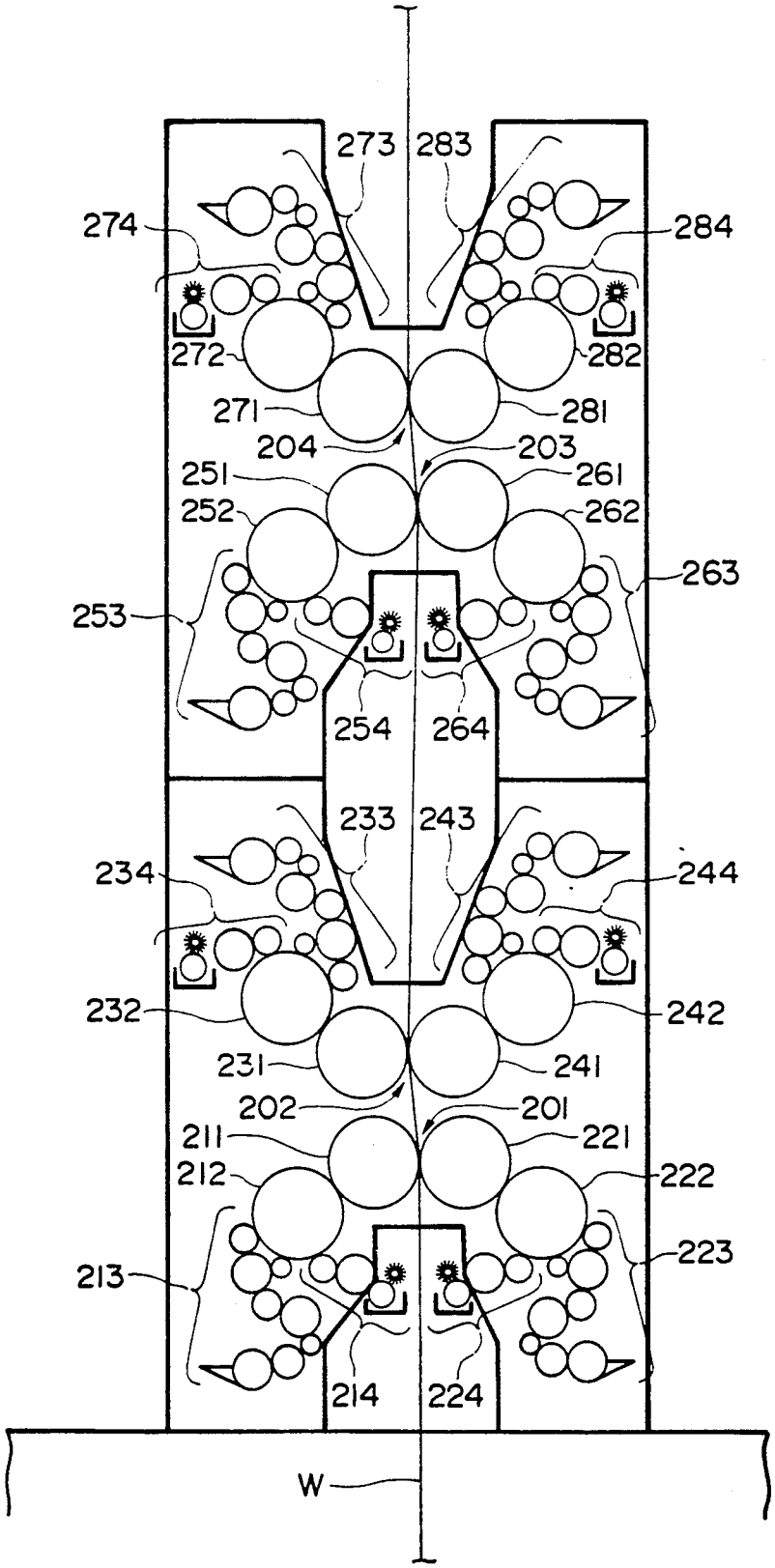
FIG. 6 is a schematic illustration showing one example of configuration of a conventional both sides color printing apparatus.

If the conventional both sides color printing apparatus shown in FIG. 6, is provided with the fine adjusting means shown in FIG. 2 to FIG. 5, the improved configuration will satisfy the first object of the present invention. Therefore, such improved configuration will belong to the present invention.

Although the paper web W will be also be extended in its longitudinal direction by the ink and dampening water during the printing work, the extended amount will be remarkably smaller than that in the lateral direction. Thus the printing shear in the longitudinal direction can be practically ignored. However, such printing shear in the longitudinal direction may be generated owing to various reasons. To deal with such printing shear, the both sides color printing apparatus according to the present invention may be additionally provided with any adjusting means for adjusting the printing plate in the circumferential direction of the plate cylinder. Such adjusting means, not shown, would not spoil the spirit of the present invention.

As given explanation explained above, the both sides color printing apparatus according to the present invention can always adjust the axial direction, i.e. length of the plate cylinder with respect to the blanket cylinder in response to the variations in the dimension of the paper web on account of moisture, especially the dampening water without stopping the apparatus per se. Therefore this apparatus can produce the printed matters with minimizing the printing shears caused by the variation in the dimension. Further this apparatus can realize extremely high printing efficiency without skillful operators.

The printing apparatus constructed according to the present invention and employing a configuration such that the inking unit and the dampening unit for respective printing sections are arranged below the plate cylinder can completely eliminate various disadvantages present in conventional both sides color printing apparatus; for example, complicated works in their design, poor effectively in plate setting works, mistake in their inking and dampening operations, complicated operation in their maintenance, and so on. Further, this arrangement does not require skillful operators for adjusting the inking and the dampening, and can reduce the number of rollers shown in FIG. 1. As a result, the printing apparatus according to the present invention can be manufactured in a relatively compact size and at a low cost.

Although the invention has been described in its preferred form with a certain degree of particularity, it is understood that the present disclosure of the preferred form can be changed in the details of construction and the combination and arrangement of parts may be resorted to without departing from the spirit and the scope of the invention as hereinafter claimed.

what is claimed is:

1. A color printing apparatus for applying colored ink to both sides of a printing paper comprising a plurality of printing sections which are arranged spaced apart from one another at regular intervals in a piled configuration, wherein each of said printing sections includes:

a pair of blanket cylinders which face each other and which each can be moved between a contacting position and an isolating position;

a plate cylinder connected to each of said blanket cylinders and provided with an inking unit, or an inking unit and a dampening unit;

fine adjusting means, connected to each of said plate cylinders, for shifting said plate cylinder in its axial direction while said plate cylinder is rotating to adjust the position of said plate cylinder with respect to said blanket cylinder so as to compensate for variations in the dimensions of said paper web resulting from the presence of varying amounts of moisture in said paper web, wherein said plate cylinder includes at least two sections each of which is independently adjusted in its axial direction by said fine adjusting means.

2. The printing apparatus according to claim 1, wherein said inking unit or said inking unit and said dampening unit are arranged below said plate cylinder.

3. An apparatus for printing colored ink on both sides of a printing paper, said apparatus including a first printing station which comprises:

(A) a pair of blanket cylinders which face each other and which are movable from a position in which they contact one another to a position in which they are isolated from one another;

(B) a pair of plate cylinders, each of said plate cylinders contacting a respective one of said blanket cylinders;

(C) a pair of inking units for supplying ink to said plate cylinders; and (D) fine adjusting means, connected to each of said plate cylinders, for adjusting the axial position of said plate cylinder with respect to said blanket cylinder while said plate cylinder is rotating so as to compensate for variations in the dimensions of said paper web resulting from the presence of varying amounts of moisture in said paper web, wherein at least one of said plate cylinders comprises at least two co-axial undivided sections, one of which is adjusted in its axial direction by said fine adjusting means.

4. The apparatus of claim 3, wherein each of said inking units comprises an inking roller in contact with a respective one of said plate cylinders, a metering roller in contact with said inking roller, and means for supplying ink to said mesh roller.

5. The apparatus of claim 4, wherein said means for supplying ink comprises an ink fountain and an ink fountain roller which contacts said metering roller and which is at least partially disposed in said ink fountain.

6. The apparatus of claim 4, further comprising a doctor blade in contact with said metering roller.

7. The apparatus of claim 3, further comprising second through fourth printing stations which are sequentially piled on top of said first printing station.

8. The apparatus of claim 3, wherein said fine adjusting means comprises a drive device, a first gear connected to said drive device, a bearing housing which is fixedly connected to said first gear and which has external threads provided thereon, and a female screw section which engages said external threads of said bearing housing and which is connected to said one of said undivided sections of said plate cylinder.

9. The apparatus of claim 8, wherein said drive device comprises an electric motor and wherein said fine adjusting means further comprises a second gear connecting said electric motor to said first gear.

10. A process comprising the steps of:

(A) supplying ink and dampening water to each of a pair of opposed plate cylinders;

(B) rotating said plate cylinders to apply said ink and said dampening water to each of a pair of blanket cylinders which face one another;

(C) rotating said blanket cylinders to supply said ink and said dampening water to both sides of a paper web travelling between said blanket cylinders; and (D) adjusting the axial position of at least one of said plate cylinders with respect to the associated blanket cylinder when said plate cylinder is rotating to compensate for variations in the width of said paper web resulting from variations in moisture in said web, whereby printing shears caused by variations in the width of said paper web are minimized, wherein said step (D) comprises actuating a drive device to rotate a first gear connected to said drive device which rotates a bearing housing which is fixedly connected to said first gear and which has external threads pivoted thereon which in turn cause axial movement of a female screw section which engages said external threads of said bearing housing and which is connected to one of two coaxial sections of said plate cylinder.

* * * * *